US005662146A

United States Patent [19]

Homma et al.

[11] Patent Number: 5,662,146

[45] Date of Patent: Sep. 2, 1997

[54] WARP FEEDING APPARATUS AND METHOD FOR MULTIFIBER FLAT CARBON YARNS

[75] Inventors: Kiyoshi Homma, Oumihachiman; Akira Nishimura; Ikuo Horibe, both of Iyo-gun, all of Japan

[73] Assignee: Toray Industries, Inc., Tokyo, Japan

[21] Appl. No.: 620,313

[22] Filed: Mar. 22, 1996

Related U.S. Application Data

[62] Division of Ser. No. 373,642, Jan. 17, 1995, Pat. No. 5,538,049, which is a division of Ser. No. 123,156, Sep. 7, 1993, Pat. No. 5,396,932.

[30] Foreign Application Priority Data

| | | | |
|---|---|---|---|
| Sep. 8, 1992 | [JP] | Japan | 4-239224 |
| Apr. 5, 1993 | [JP] | Japan | 5-077967 |

[51] Int. Cl.[6] ..... D03D 49/04

[52] U.S. Cl. ..... 139/97; 139/445

[58] Field of Search ..... 139/450, 445, 139/435.1, 420 A, 97

[56] References Cited

U.S. PATENT DOCUMENTS

| | | | |
|---|---|---|---|
| 4,320,160 | 3/1982 | Nishimura et al. . | |
| 4,875,506 | 10/1989 | Gacsay et al. . | |
| 4,962,796 | 10/1990 | Grimm et al. | 139/450 |
| 4,986,316 | 1/1991 | Morohashi et al. | 139/452 |
| 5,021,283 | 6/1991 | Takenaka et al. . | |
| 5,118,569 | 6/1992 | Kuroda et al. . | |
| 5,295,516 | 3/1994 | Tanaka et al. | 139/452 |
| 5,396,932 | 3/1995 | Homma et al. | 139/420 A |
| 5,538,049 | 7/1996 | Homma et al. | 139/450 |

FOREIGN PATENT DOCUMENTS

| | | | |
|---|---|---|---|
| 538079 | 5/1955 | Belgium . | |
| 538079 | 5/1955 | France | 139/420 A |
| 2715046 | 10/1977 | Germany . | |
| 2615046 | 10/1977 | Germany | 139/420 A |
| 58-191244 | 11/1982 | Japan . | |
| 58-191244 | 11/1983 | Japan | 139/420 A |
| 2-74645 | 3/1990 | Japan | 139/429 |
| 513264 | 11/1971 | Switzerland | 139/429 |

*Primary Examiner*—Andy Falik

*Attorney, Agent, or Firm*—Birch, Stewart, Kolasch, Birch, LLP

[57] ABSTRACT

A method and apparatus for supplying twist free flat warp containing a plurality of carbon fibers to a plurality of wefts in a weaving loom, wherein the warp is transversely removed from a plurality of bobbins and twisted along a longitudinal travelling direction of the warps so that flat surfaces of individual flat warps are oriented at a right angle to an arranged direction. The plurality of flat warps are reeded to a desired density in relation to the arranged direction. The warps are then twisted along the longitudinal travelling direction so that the flat surfaces of the individual flat warps are oriented to the arranged direction.

5 Claims, 7 Drawing Sheets

WARP FEEDING APPARATUS AND METHOD FOR MULTIFIBER FLAT CARBON YARNS

This application is a divisional application of Ser. No. 08/373,642, filed Jan. 17, 1995, now U.S. Pat. No. 5,538,049, which is a divisional application of Ser. No. 08/123,156, filed Sep. 7, 1993, now U.S. Pat. No. 5,396,932, the entire contents of each being hereby incorporated by reference.

BACKGROUND OF THE INVENTION

1. Field of the Invention

The present invention relates to a method and apparatus for supplying twist free flat warp containing a plurality of carbon fibers to a weaving loom.

2. Description of Related Arts

The carbon fiber woven fabric, which is made of carbon fibers having high specific Young's modulus and high specific strength, is normally woven by a general shuttle loom or rapier loom. Such carbon fiber woven fabric is frequently used as a reinforcing base fabric for composite materials including carbon fiber reinforced plastic (hereinafter referred to as "CFRP") by compounding it with a matrix resin and molding them into a specific shape.

As a composite material using such a reinforcing base fabric, the CFRP, for example, is starting to be used as a structural material or the like for aircraft owing to its excellent performance. To further expand the application field of the CFRP, it is important to reduce the cost of the molding and also of the carbon fiber and the reinforcing base fabric for carbon fiber woven fabric (hereinafter referred to as "CF fabric").

The carbon fiber yarn (hereinafter referred to as "CF yarn") can be manufactured with higher productivity in the precursor, oxidation process, and carbonization process and at lower cost as the yarn size increases.

A typical CF fabric, however, is made of CF yarn which coheres to have a nearly round cross section; therefore, in a woven state, the cross section of the CF yarn at a point at which the warp and weft cross each other is elliptic, with the weaving yarn being significantly crimped. This trend is conspicuous especially in a CF fabric which uses CF yarn with a large yarn size because warp and weft of a large yarn size cross each other.

Hence, in the CF fabric with considerably crimped CF yarn, the fiber density tends to be nonuniform, preventing high strength, which is a feature of carbon fiber, from being fully exhibited. In addition, the CF fabric using CF yarn with a large yarn size is normally accompanied by more weight of woven fabric (g/m$^2$) and increased thickness. This adversely affects the resin infiltration property when manufacturing a preimpregnated material (hereinafter referred to simply as "prepreg"), or molding a fiber reinforced plastic (hereinafter referred to as "FRP").

Therefore, CFRP produced by using a CF fabric woven with CF yarn with a large yarn size inevitably has more voids present in the resin, failing to exhibit high strength.

On the other hand, in the case of a CF fabric which is woven with CF yarn of a large yarn size and which has a smaller weight of woven fabric, the gaps formed between CF yarns are larger. For this reason, forming CFRP using the CF fabric with a smaller weight of woven fabric presented a disadvantage in that the CF yarn content is low and resin voids occur intensively in the gaps which are formed between the CF yarns, thus making it impossible to acquire a high-performance CFRP.

Unexamined Japanese Patent Publication (KOKAI) No. 58-191244 discloses a thin woven fabric, which uses a thin, wide and flat CF yarn, and has a thickness of 0.09 mm or less and a weight of woven fabric of 85 g/m$^2$ or less, and its weaving method which eliminate the disadvantage described above. Since this thin woven fabric is extremely thin, the crimps of the weaving yarn are small; therefore, high reinforcing effect is ensured, making it a good basic fabric for molding a thin CFRP.

The CF fabric using such a flat CF yarn is woven by successively shedding, by a heald, a warp supplied from a beam wound with the required number of CF yarns or a sheet-like warp supplied from a CF yarn bobbin which is mounted on a creel, and by intermittently inserting weft into the open sheds using a shuttle or rapier.

In this case, the warp is supplied through a beam or directly from a bobbin as described above. In either way, there are two methods; one is the transverse take-out wherein the warp is taken out, while slowly turning the CF yarn bobbin, by pulling it out in a direction so that it crosses with the rotary axis at right angle, and the other is the longitudinal take-out wherein the warp is taken out by pulling it out in a direction of the axis of the bobbin.

Since the warp is paid out in the direction of the axis of the bobbin in the longitudinal take-out, this method is more advantageous than the transverse take-out in that the warp can be paid out instantly at high speed without drag. In the longitudinal take-out, however, the warp is twisted once each time the warp is paid out from the bobbin. Thus, the flatness of the warp at the twisted portion is crushed and partially squeezed. This presents a problem in which a CF fabric with a uniform warp yarn width cannot be obtained.

To solve such a problem, a weaving method can be considered whereby to prevent the warp from being twisted by using the transverse take-out instead. In a conventional heald, however, the mail is made to be longer than it is wide in order to minimize the chance of interference with warp. This causes the mail or the comb, which makes warp density uniform, to crush the flatness of warp, and a fabric with uniform yarn width throughout the fabric cannot be produced.

On the other hand, the weft must be quickly supplied to the above-mentioned open sheds; therefore, the weft supplying speed needs to be higher than that of the warp. Hence, to quickly take out the weft from the fiber yarn bobbin, the longitudinal take-out, whereby the weft is paid out in the direction of the axis of the fiber yarn bobbin, is widely used. This, however, presents a problem in that the yarn is twisted.

To solve such a problem, in Unexamined Japanese Patent Publication No. 2-74645, a method, wherein a bobbin with weft wound around it is actively rotated by a motor and the weft in a length required for inserting it is retained making use of gravity, is suggested.

However, this method wherein the bobbin is actively rotated presents a problem in that the take-out speed must be changed according to the amount of weft wound around the bobbin. In addition, the motor is intermittently run in accordance with the insertion of weft, and therefore, the motor is started and stopped frequently, causing the flat CF yarn to be slackened and thus twisted due especially to the lag in the stopping motion.

Further, to minimize the crimp of weaving yarn at a crossing point of warp and weft, it is desirable that the fiber constituting the weaving yarn has as large a yarn size as possible, the weaving yarn is thinner, and the warp and weft have yarn intervals that are nearly equal to their yarn width in making up the fabric.

On the other hand, however, the yarn width tends to considerably increase as the yarn size of weaving yarn increases, thus the flatness of yarn is crushed at the time of weaving, making it impossible to produce a fabric with a uniform fiber density. There is another problem in that, if weaving yarn is extremely thin and has an extremely small width, then the rigidity in the direction of the yarn width becomes low, causing the flatness of yarn to be easily crushed at the time of weaving.

In this case, it is desirable to apply a sizing agent to the weaving yarn to maintain the flatness of the weaving yarn. Excessive application of the agent, however, will prevent the resin infiltration for CFRP at the time of molding, and the resulting CFRP will fail to exhibit high strength. The desirable amount of the sizing agent to be applied is 0.5 to 2.0 percentage by weight.

Further, in the thin woven fabric and its weaving method disclosed in Unexamined Japanese Patent Publication No. 58-191244 previously mentioned, to form medium or thick CFRP, an enormous number of pieces of base fabric or woven fabric prepreg must be laid up. Thus, this method is disadvantageous in that the formed CFRP costs high and the forming work is extremely time-consuming.

Hence, conventionally, using a CF yarn with a larger yarn size prevents acquisition of a CFRP featuring excellent strength, and no satisfactory method or apparatus is available for weaving a CF fabric from a flat CF yarn. There has been demand for satisfactory method or apparatus for that purpose.

SUMMARY OF THE INVENTION

The present invention provides a weaving method and a weaving apparatus which make it possible to weave the above-mentioned CF fabric while maintaining the flatness of yarn without causing twist even when a flat CF yarn with a larger yarn size is used.

To fullfill the above objects, present invention provide a carbon fiber woven fabric which comprises a flat carbon fiber yarn consisting of many carbon fibers as at least its warp or weft.

It is a must for the CF yarn to have no twist. If the CF yarn should have any twist, then the yarn will be squeezed and the yarn width will be decreased at the twisted portion, resulting in an increased thickness, thus causing irregularities on the surface of the woven fabric. As a result, when an external force is applied to the woven fabric, the stress will be concentrated onto the twisted portion, leading to nonuniform strength when the fabric is formed into FRP or the like.

To weave with such a flat CF yarn free from twists, the CF fabric weaving method according to the present invention, whereby a CF fabric is woven by using twist-free, flat CF yarn as at least its warp or weft, said flat Cf yarn consists of a plurality of carbon fibers and by supplying weft to between a plurality of arranged warps, is designed to comprise at least a weft supply process, wherein the flat weft is subjected to the transverse take-out and positioned horizontally in the weft supply position by a guiding means, the weft of a length required for each insertion of weft for the aforesaid warp is retained between the take-out position of the weft and the guiding means by making use of the elastic force, and the weft with the tension applied is supplied to the guiding means, and a warp supply process, wherein the plurality of flat warps are subjected to the transverse take-out, the plurality of warps are held so that their flat surfaces lie in a direction crossing at right angle the arranged direction and combed to the desired density in relation to the arranged direction, then the direction of the flat surfaces of the individual warps is changed to the arranged direction to lead them to a shuttle path forming means.

According to the CF fabric weaving apparatus of the present invention, whereby a CF fabric is woven by using twist-free, flat CF yarn, at least the flat warp or weft thereof consists of a plurality of carbon fibers, and by supplying weft to between a plurality of arranged warps, the apparatus for weaving CF fabric is designed to comprise at least either a weft supply means, which includes a draw-off roller that rotates interlocking with a rotary main shaft of the weaving apparatus and pays out the flat weft from a weft bobbin wound with weft at a constant speed, at least two guide rollers which horizontally place the paid out weft in the weft supply position, a weft elastic suspension mechanism which elastically retains the weft of a length required for each insertion of weft into warps at between the draw-off roller and the guide rollers and supplies the weft to the foregoing at least two guide rollers, and a tension applying mechanism which keeps under tension the weft received from the guide rollers, or a warp supply means, which includes a comb that has a plurality of wires and combs the individual warps paid out from a plurality of warp bobbins wound with flat warps by bringing the individual warps into contact only with the wires located in the corresponding positions, thereby arranging them to the desired density while maintaining the flatness of the warps, a guide which change the orientation of the plurality of warps received from the comb into a direction that crosses with the plurality of wires of the comb at right angle, and a heald which opens and closes the plurality of warps received from the guide while maintaining their new orientation.

In the weaving method and weaving apparatus for CF fabric according to the present invention, twisting the weft at the time of weaving can be prevented by transversely taking out the weft while giving a weft bobbin a given rotation by a draw-off roller interlocked with a main rotary shaft of the apparatus, causing the slack in the weft, which is generated by an insertion of the weft into warps, to be absorbed, positioning the weft by guide rollers, and applying tension to the weft by a tension applying mechanism.

Further in the weaving method and weaving apparatus for CF fabric according to the present invention, a CF fabric can be woven with the flatness of the warps unimpaired by transversely taking out the warps from a plurality of warp bobbins, combing the warps by bringing the flat surfaces of the warps into contact only with the wires of the comb to arrange them to the desired density, and changing the orientation of the flat surfaces of the warps into the horizontal direction before guiding them to a heald.

According to the weaving method and weaving apparatus for CF fabric of the present invention, a CF fabric can be woven without causing flat CF yarns to be twisted or the flatness to be crushed, thus allowing extremely thin fabrics to be produced with consistent quality. Hence, using this fabric for producing prepregs or CFRPs prevents such problems as irregularities on the surface caused by irregular thickness occurring in yarn-twisted portions, excess resin in gaps in yarn-twisted portions, occurrence of voids, and deteriorated strength due to concentration of stress onto twisted portions.

Other aspects of the present invention are described in Applicants' prior U.S. Pat. Nos. 5,538,049 and 5,396,932, issued Jul. 23, 1996 and Mar. 14, 1995, respectively, the entire contents of which are hereby incorporated by reference into the present application.

The above and other objects, characteristics and advantages of the present invention will become more apparent from the following detailed description made in connection with the accompanying drawings.

DETAILED DESCRIPTION OF THE PREFERRED EMBODIMENTS

The following presents detailed description of an embodiment related to the CF fabric, its weaving method and weaving apparatus according to the present invention, referring to FIG. 1 through FIG. 9.

Figure 1:
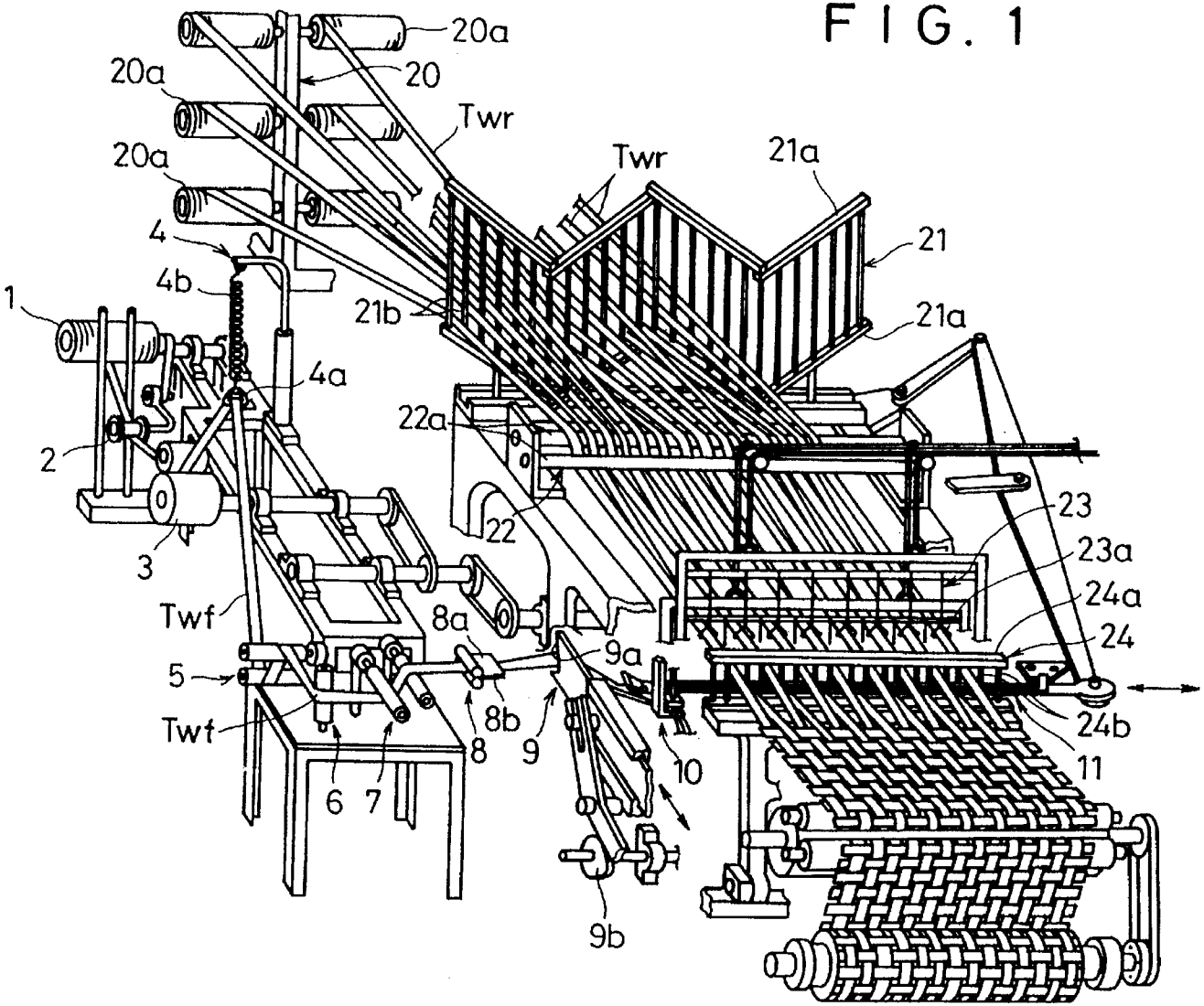
FIG. 1 is a schematic configuration diagram of the weaving apparatus for weaving CF fabric by applying the weaving method for CF fabric according to the present invention.

FIG. 1 shows a weaving apparatus which weaves a CF fabric by applying the weaving method for CF fabric according to the present invention. The weaving apparatus is provided with a bobbin 1, a draw-off roller 3, a tension device 4, guide rollers 5 to 7, a leaf spring tension device 8, a presser plate guide 9, and a rapier 11 mainly as a weft supply unit, and it is provided with a creel 20, comb 21, a horizontal guide 22, a heald 23, and a reed 24 as a warp supply unit.

First, the weft supply unit will be explained. The bobbin 1 is wound with a weft $T_{wf}$, which is a flat CF yarn consisting of many carbon fibers, and the weft $T_{wf}$ is guided to the draw-off roller 3 via the tension roller 2 then it is taken out at a constant speed by the revolution of the draw-off roller 3.

In this case, when the weft $T_{wf}$ is taken out from the bobbin 1, the tension roller 2 is in its upper position, while the roller automatically moves down when the revolution of the draw-off roller 3 stops, and a brake is operated to stop the inertial rotation of the bobbin 1. The draw-off roller 3 rotates, being interlocked to a main rotary shaft 26 of the weaving apparatus to be described later, and the main rotary shaft 26 is rotated by a driving motor 25 (see FIG. 3) to be discussed later.

The speed at which the weft $T_{wf}$ is taken out, i.e., the surface speed obtained by the rotation of the draw-off roller 3, can be easily determined when the number of revolutions (rpm) of the main rotary shaft 26 and the length (m) of the weft required for one rotation are found.

The CF yarn for the weft $T_{wf}$ and warp $T_{wr}$ is twist-free and has 6,000 to 36,000 carbon fibers. The CF yarn is maintained in a flat shape using a sizing agent or the like in advance and it is wound around a bobbin 1, which is a cylindrical tube having a given traverse width, or bobbins 20*a* and 20*b* of the creel 20 to be described later.

The CF yarn to be used has a yarn size of 3,000 to 30,000 deniers, a yarn width of 4 to 16 mm, a yarn thickness of 0.07 to 0.6 mm, and a ratio of yarn width to yarn thickness of 20 to 150. If a flat unit CF yarn formed into a plurality of layers is used, the unit CF yarn must be free of twists and have 3,000 to 12,000 carbon fibers, a yarn size of 1,500 to 10,000 deniers, a yarn width of 4 to 16 mm, a yarn thickness of 0.07 to 0.2 mm, and a ratio of yarn width to yarn thickness of 30 to 150.

The weft $T_{wf}$ taken out from the draw-off roller 3 is led to the leaf spring tension device 8, being guided by the horizontal guide roller 5, a vertical guide roller 6, and a horizontal guide roller 7 via a guide 4*a* of the tension device 4.

Each of the guide rollers 5 through 7 preferably has a diameter of approximately 10 to 20 mm and a length of 100 to 300 mm, and is preferably of a rotary type which incorporates a bearing. If the diameter is too small, then the CF constituting the weft $T_{wf}$ bends, often causing a single yarn to break. On the other hand, if the diameter exceeds 20 mm, a problem occurs in which the inertia of rotation increases, causing increased changes in tension at the time of start and stop.

The guide rollers 5 through 7 need to have a sufficient length so that the passing weft $T_{wf}$ does not come in contact with the support portion which support the guide rollers 5 through 7 when the weft $T_{wf}$ moves horizontally or vertically. If the weft $T_{wf}$ should touch the support portion of the guide rollers 5 through 7, then the flatness is crushed.

The horizontal guide roller 5 and 7 determines the height of the weft $T_{wf}$ to be guided, while the vertical guide roller 6 determines the horizontal position of the weft $T_{wf}$. Accordingly, at least horizontal and vertical guide rollers 5 through 7 need to be installed alternately.

In this case, it is necessary to twist the flat surfaces of the weft $T_{wf}$ 90 degrees at between the horizontal guide rollers 5 and the vertical guide roller 6 and at between the vertical guide roller 6 and the horizontal guide rollers 7. For this reason, a distance of 50 mm or more must be provided between the guide rollers 5 and 6 and between the guide rollers 6 and 7 although it varies depending on the width of the weft $T_{wf}$.

If the distance between the guide rollers is smaller than 50 mm, then the weft $T_{wf}$ will pass through the vertical guide roller 6 and the horizontal Guide rollers 7 and will be woven in a twisted state. Likewise, if the CF yarn is twisted 90 degrees in a shorter distance, then tension will be applied to both ends of the CF yarn, causing fuzz to be generated.

It is possible to use only a single guide roller for each of the rollers 5 through 7, but using a pair of them so that the weft $T_{wf}$ passes in an S shape ensures consistent tension applied to the weft $T_{wf}$ and therefore permits accurate positioning of the weft $T_{wf}$.

The tension device 4 functions to constantly keep the weft $T_{wf}$ tense by absorbing the slack between the draw-off roller 3 and the horizontal guide rollers 5 of the weft $T_{wf}$ which is taken out at a constant speed by the draw-off roller 3 when the weft $T_{wf}$ is inserted intermittently by the rapier 11 to be discussed later. Unless the weft $T_{wf}$ is kept tense by a spring 4*b*, it is twisted when it slacks and it is likely to pass through the guide rollers 5 through 7 and be woven in the twisted state. A guide 4a provided at the bottom end of the spring 4b is arranged sideways so that the flat surfaces of the CF yarn is guided horizontally.

As another method for keeping the weft $T_{wf}$ tense, there is a method based on air suction, but this method presents a problem in that the weft $T_{wf}$ is twisted during suction. Likewise, in a method where a weight is used to keep the weft $T_{wf}$ tense, the fluctuations in tense tend be too much, damaging the carbon fibers which make up the weft $T_{wf}$. Thus, the method which uses a spring as described above is the easiest and reliable method.

On the downstream side of the horizontal guide roller 7 of the weft $T_{wf}$ is provided a tension device 8 which functions to keep the tension of the weft $T_{wf}$ even. The tension device 8 keeps the tension of the weft $T_{wf}$ even by holding the weft $T_{wf}$ with two wide leaf springs 8a and 8b.

In the method for supplying the weft $T_{wf}$ of the CF fabric weaving apparatus according to the present invention, in principle, the yarn path of the weft $T_{wf}$ is determined by the vertical guide roller 6, but the yarn path of the weft $T_{wf}$ sometimes changes due to fluctuations in the tension or when hooking onto the rapier. For this reason, it is necessary to make sure that there is no obstacle that interferes with the side edge of the weft $T_{wf}$ when the weft $T_{wf}$ moves widthwise, and therefore, the tension device 8 provided with the wide leaf springs 8a and 8b is used. The width of the leaf springs 8a and 8b should be five times the yarn width of the weft $T_{wf}$ or more.

The presser plate guide 9 is located on the down-stream side of the weft $T_{wf}$ of the leaf spring tension device 8, and it has a V-shaped guide surface 9a at its end. The guide 9 is interlocked with the yarn supplied to the rapier 11 and driven longitudinally as shown by the arrowhead in FIG. 1 by making use of the cam 9b to which the rotation of the main rotary shaft 26 is transferred.

Figure 5:
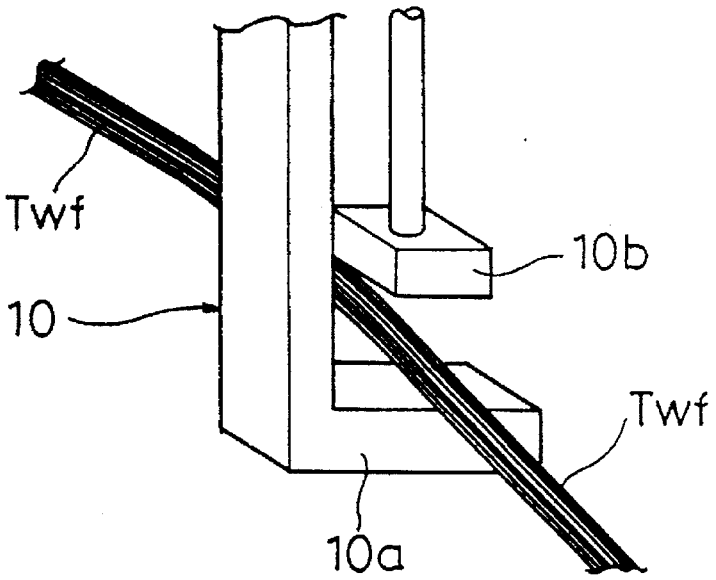
FIG. 5 is a perspective view which shows an enlarged view of a yarn end holding guide.

A yarn end holding guide 10 is located in the vicinity of the downstream side of the presser plate guide 9. The yarn end holding guide 10 has, as shown in FIG. 5, an L-shaped receiving member 10a and a pressing member 10b which is driven up and down by a driving means not shown. The pressing member 10b of the guide 10 goes down and holds the end of the weft $T_{wf}$ by pressing it against the receiving member 10a.

Thus, when the presser plate guide 9 is pushed out in the direction of the arrowhead and the flat surface of the weft $T_{wf}$ moves down as it is guided along the slope of the V-shaped guide surface 9a, the yarn end holding guide 10 also moves down. As the result of the weft $T_{wf}$ crossing the end of the rapier 11 with its flatness kept intact, it is properly hooked onto a hook 11a of the rapier 11 to be described later.

In this case, normally, the weft $T_{wf}$ is retained in a standby position by the yarn end holding guide 10 and a yarn supply guide having a guide hole so that the weft $T_{wf}$ crosses the rapier 11 aslant, and when the rapier 11 reaches the yarn supply position, both guides are moved down to cause the weft $T_{wf}$ to be hooked onto the hook 11a of the rapier 11. However, if a standard yarn supply guide is used for a weft $T_{wf}$ consisting of a flat CF yarn to supply the yarn to the rapier 11, then the weft $T_{wf}$ is rubbed by the above-mentioned guide hole, damaging the flatness.

To avoid this problem, in the weaving apparatus according to the present invention, the presser plate guide 9 is provided between the leaf spring tension device 8 and the yarn end holding guide 10. Thus, the yarn end holding guide 10 moves down and the presser plate guide 9 advances when the yarn is supplied to the rapier 11, thereby pressing the weft $T_{wf}$ against the rear of the weaving apparatus (farther side in FIG. 1) and making the weft $T_{wf}$ pass across the rapier 11.

Figure 2:
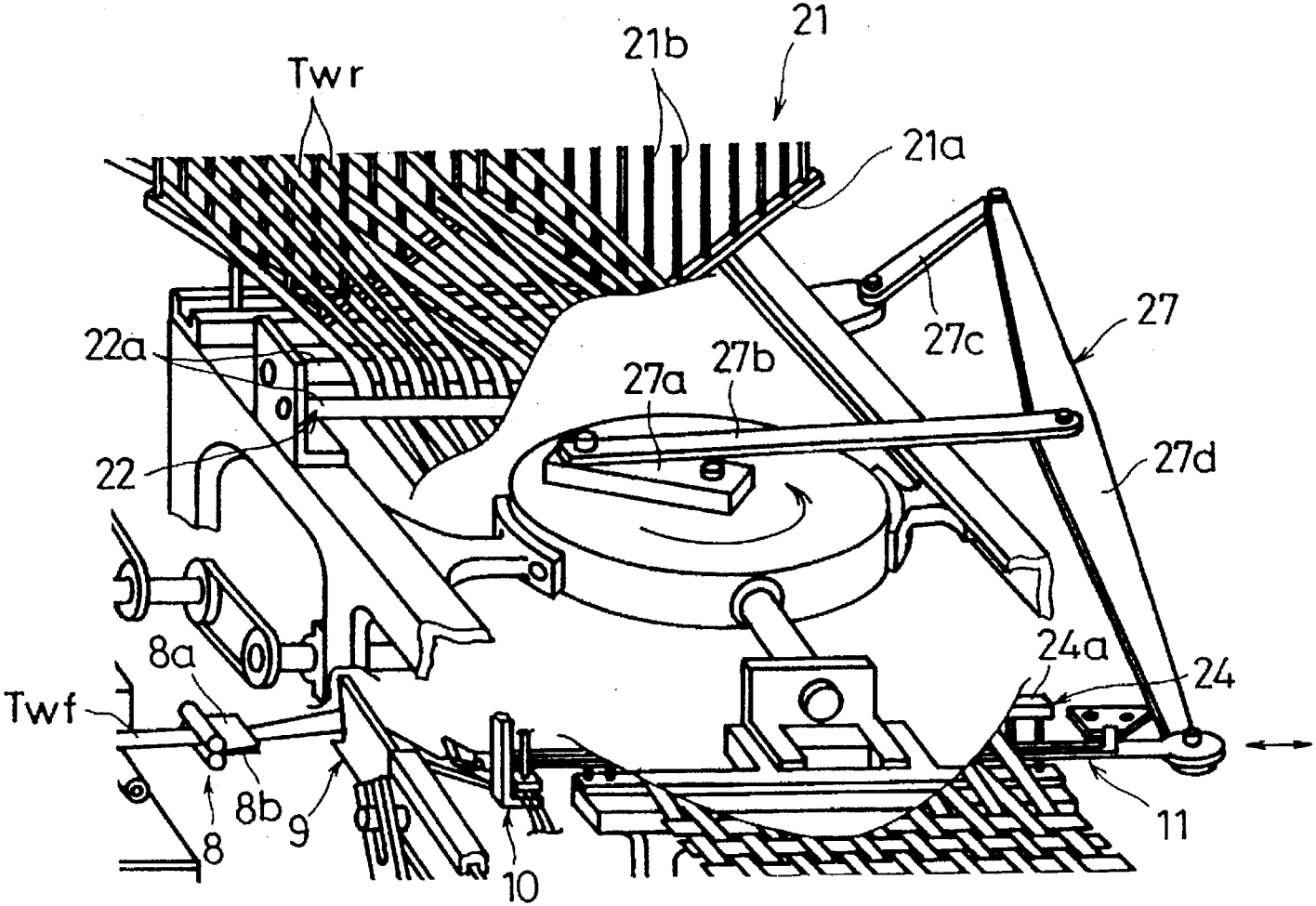
FIG. 2 is an enlarged view of the major section which shows a driving means of a rapier in the weaving apparatus of FIG. 1.
Figure 3:
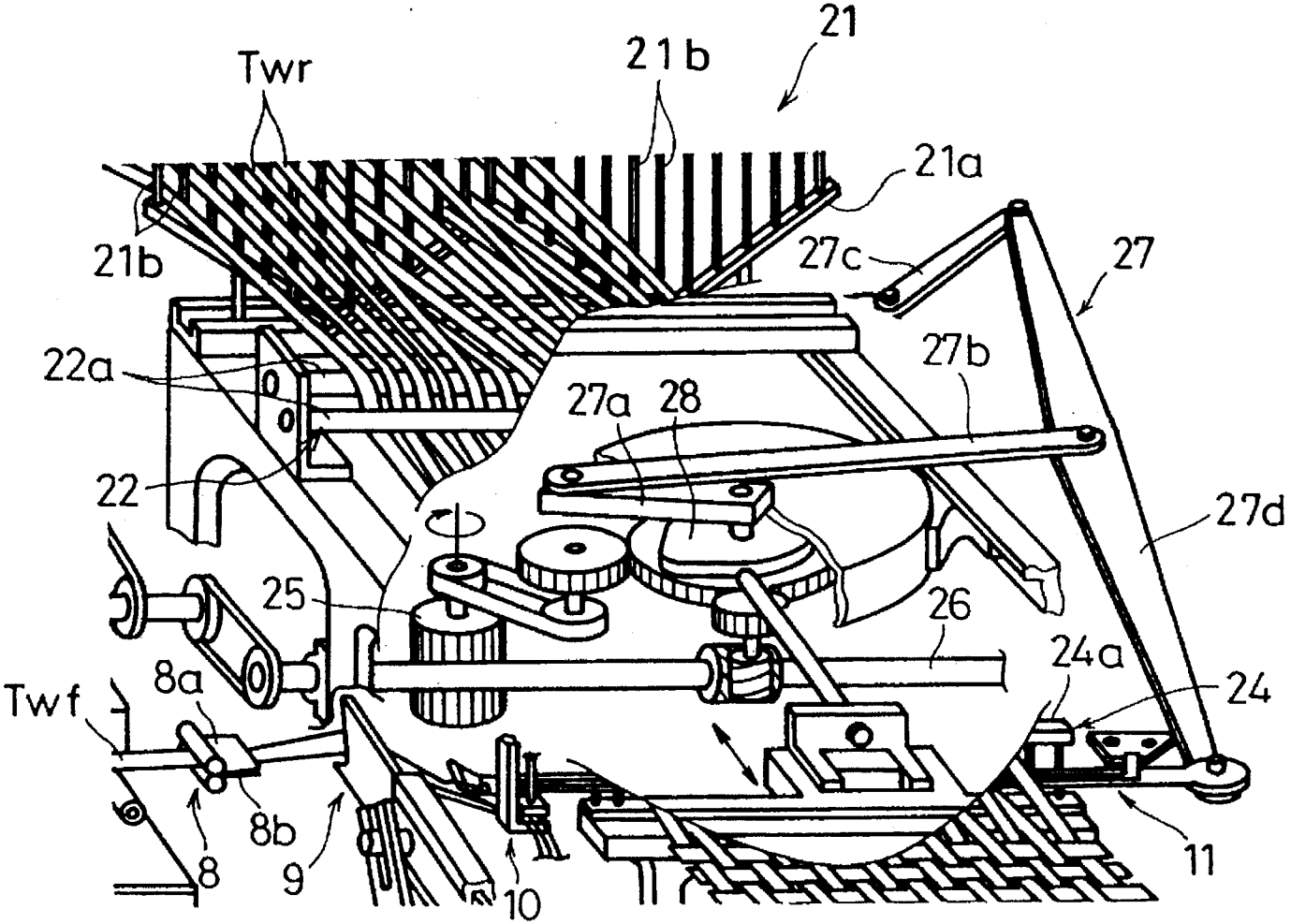
FIG. 3 is an enlarged view of the major section which shows more details of a part cut away from FIG. 2.
Figure 4:
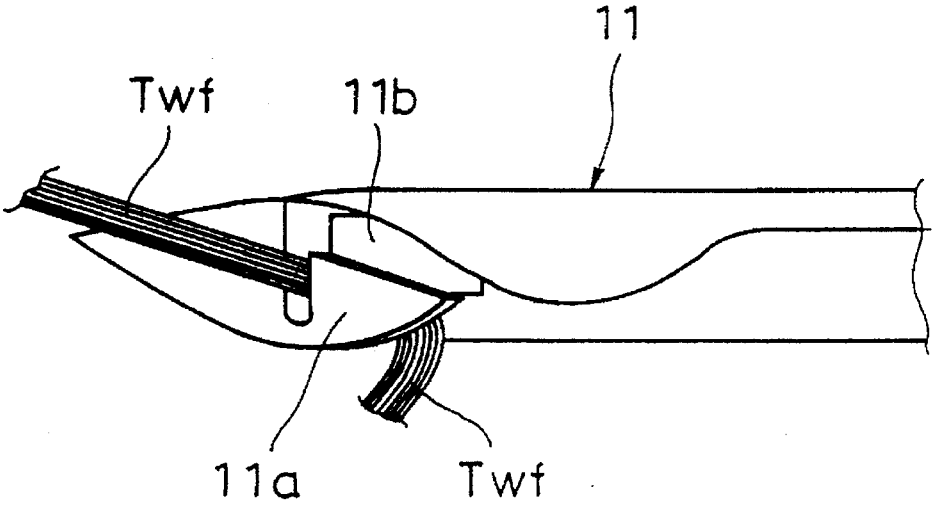
FIG. 4 is an enlarged view of the tip of the rapier.

As shown in FIG. 1, the rapier 11 is a longitudinal member located near a reed 24 to be discussed later, and it intermittently moves laterally to insert the weft $T_{wf}$ between multiple warps $T_{wr}$. The rapier 11, as shown in FIG. 2 and FIG. 3, is intermittently moved by the driving force transmitted from a driving motor 25 via a linking means 27 which has arms 27a through 27d. As shown in FIG. 4, the rapier 11 has, on its tip, the hook 11a for hooking the flat weft $T_{wf}$, and a presser member 11b being mounted near the hook 11a.

Accordingly, the weft $T_{wf}$ is hooked onto the hook 11a on the rapier 11 when the rapier 11 moves to the right in FIG. 1, then it is pressed and held by the presser member 11b.

Figure 6:
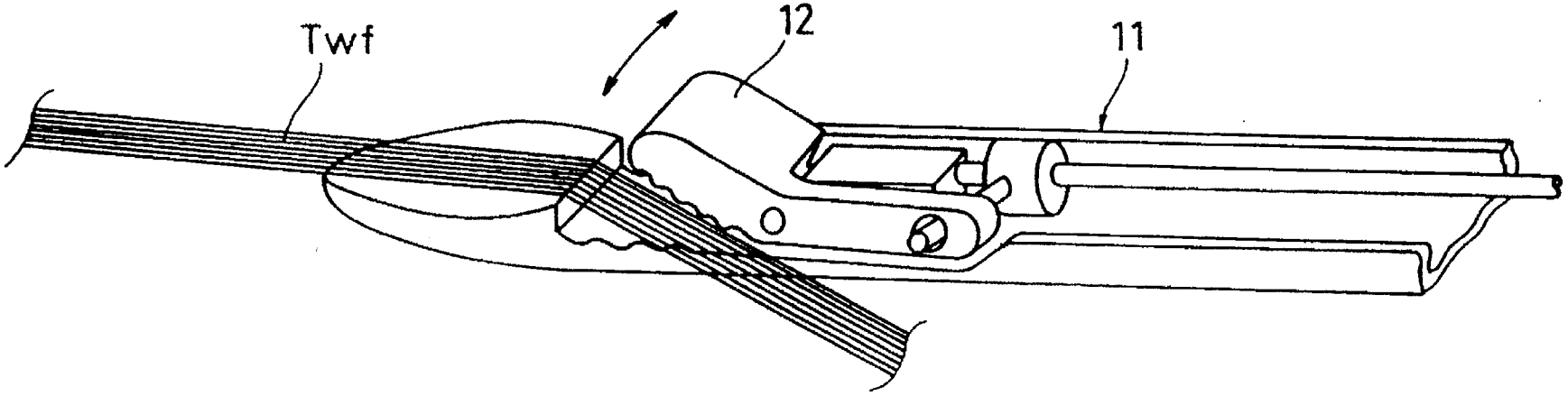
FIG. 6 is a perspective view which shows another mode wherein weft is held by the rapier.

To grasp the flat weft $T_{wf}$ by the rapier 11, the end of the weft $T_{wf}$ led to the tip of the rapier 11 is grasped by a clamping tool 12 as shown in FIG. 6. This makes it possible to insert the weft $T_{wf}$ while keeping its flatness almost unimpaired.

In the weaving apparatus for CF fabric according to the present invention, the weft $T_{wf}$ wound around the bobbin 1 is paid out at a constant speed by the draw-off roller 3 during the weft supply process performed by the weft supply unit described above, and the slack which takes place when the weft $T_{wf}$ is inserted intermittently by the rapier 11 is absorbed by the spring 4b of the tension device 4.

Then, the weft $T_{wf}$, which has been taken out transversely from the bobbin 1, is guided by the guide rollers 5 through 7 and hooked onto the hook 11a of the rapier 11 by the cooperation of the presser plate guide 9 and the yarn end holding guide 10 while the tension of the weft $T_{wf}$ being kept uniform by the leaf spring tension device 8, then it is inserted between the multiple warps $T_{wr}$ shown in FIG. 1.

Thus, the weft $T_{wf}$ consisting of CF yarn can be woven in without being twisted or incurring damage to its flatness.

The warp supply unit will now be described. The creel 20 supports many bobbins 20a in a manner that they are free to rotate. Just as the bobbin 1 of the weft supply unit, each bobbin 20a is wound with warp $T_{wr}$ consisting of CF yarn. The warp $T_{wr}$ is paid out transversely and led to the cloth fell through the comb 21, the horizontal guide 22, the heald 23, and the reed 24.

In this case, the speed at which the warp $T_{wr}$ is paid out from a bobbin 20a is extremely lower than that for the weft $T_{wf}$ and it is a constant speed; therefore, the bobbin 20a is equipped with just a light brake.

The comb or reed 21 consists of a plurality of wires or dents 21b which are provided vertically between the top and bottom support frames 21a and 21a at the same intervals as those for the warps $T_{wr}$ of fabric. The multiple warps $T_{wr}$ are passed between the wires 21b and 21b one by one so that they are positioned with respect to the horizontal direction, thus combing or reeding the warps $T_{wr}$ at a desired density.

In this case, it is necessary to set the wires 21b to a specified length so that the flat warps $T_{wr}$ supplied from the bobbins 20a of the creel 20 do not touch the support frames 21a and 21a but the flat surfaces of the warp $T_{wr}$ touch only the wires 21b. If the wires 21b are shorter than the specified length, then the warps $T_{wr}$ will be squeezed. The optimum length of the wires 21b is determined by the height of the creel 20 and the distances from the creel 20 to the comb 21 and to the horizontal guide 22, however, it needs to be about 300 mm.

The horizontal guide 22 has two guide bars 22*a* and it winds the warps $T_{wr}$, which have been taken out from the bobbins 20*a*, onto the two guide bars 22*a* in an S shape to restrict the vertical position.

It is now necessary to twist the flat surfaces of the warps $T_{wr}$ 90 degrees between the comb 21 and horizontal guide 22. For this purpose, the comb 21 must be spaced away from the horizontal guide 22 by at least 50 mm although the distance varies depending on the width of the warps $T_{wr}$. If the distance between the comb 21 and the horizontal guide 22 is less than 50 mm, then the warps $T_{wr}$ will be passed through the horizontal guide 22 and woven in while it is kept in a twisted state.

The healds 23 are provided one each for each warp $T_{wr}$ and they guide the individual warps $T_{wr}$, which have been vertically positioned by the horizontal guide 22, to the reed 24. The healds 23 are moved up and down by a driving means not shown, thus forming a shuttle path for passing the weft $T_{wf}$ between the multiple warps $T_{wr}$ on the downstream side of the reed 24.

In the conventional heald, the mail is made longer longitudinally to minimize the interference at between the adjoining yarn and the heald. However, passing the CF fiber through such a mail, which is longer longitudinally, crushes the flatness, preventing weaving to be performed with the flatness maintained. For this reason, it is desirable that the mail 23*a* of the heald 23 is formed so that it is longer laterally, and the lateral length of the mail 23*a* needs to be set at the same length as or slightly longer than the yarn width of the CF yarn used as the warp $T_{wr}$. The shape of the mail 23*a* should be rectangular or an ellipse which is long horizontally.

The reed 24 functions to arrange the multiple warps $T_{wr}$ paid out from the multiple bobbins 20*a* mounted on the creel 20 to a specified density and to press the weft $T_{wf}$, which has been passed into the shuttle path, against the cloth fell. The frame 24*a* has many dents 24*b* arranged vertically. As shown in FIG. 2 and FIG. 3, the reed 24 is shuttled in the running direction of the warps $T_{wr}$ shown by the arrowhead in FIG. 3 by a cam 28 to which the rotation of a driving motor 25 is transmitted, thereby pressing the weft $T_{wf}$ against the cloth fell.

In this case, the tension of the warps $T_{wr}$ should be set as low as possible. The low tension of the warp $T_{wr}$ will prevent the flatness from being crushed even if the lateral position of the reed 24 is slightly dislocated, causing the warp $T_{wr}$ guided by the heald 23 to touch the dents 24*b* or even if the heald 23 shakes and the warp $T_{wr}$ is dislocated and moved to one side of the mail 23*a*.

In the warp supply unit described above, the warps $T_{wr}$ are combed to the desired density according to the following steps and the weft $T_{wf}$ fed by the weft supply unit is pressed against the cloth fell, thus weaving the CF fabric.

First, the warps $T_{wr}$ are paid out from all the multiple bobbins 20*a* mounted on the creel 20.

The individual warps $T_{wr}$ are positioned horizontally by the comb 21 then twisted 90 degrees before they are led to the horizontal guide 22.

The multiple warps $T_{wr}$ led to the horizontal guide 22 are positioned vertically by the guide bars 22*a* and 22*a*, then they are guided to the healds 23, which are moved up and down by the driving means not shown, every other warp, thereby forming the shuttle path for inserting the weft $T_{wf}$ between the multiple warps $T_{wr}$ on the downstream side of the reed 24.

The multiple warps $T_{wr}$ paid out from the multiple bobbins 20*a* mounted on the creel 20 are arranged by the reed 24 to a specified density and guided to the cloth fell.

When the shuttle path is formed by the healds 23, the weft $T_{wf}$ is inserted between the multiple warps $T_{wr}$ by the intermittent operation of the rapier 11, and the inserted weft $T_{wf}$ is pressed against the cloth fell by the reed 24. Thus, the CF fabric is woven a shown in FIG. 1.

This warp supply process forms all warps $T_{wr}$ into a sheet-like shape in which they are arranged equidistantly, permitting stable weaving.

Figure 7:
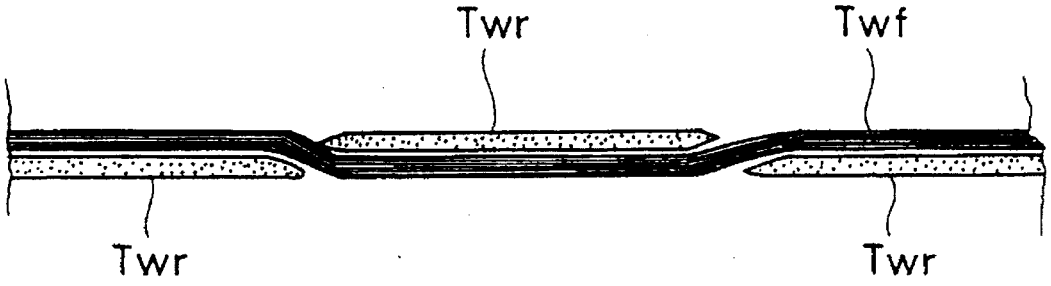
FIG. 7 is a cross-sectional view of the CF fabric according to the present invention which is woven using warp and weft consisting of a single flat CF yarn.

Thus, in the weaving method and weaving apparatus for the CF yarn according to the present invention, the warp and weft made of flat CF yarn of a large yarn size are woven, with their flatness maintained, into a thin CF fabric with a uniform fiber density. As shown in FIG. 7, almost no crimps were observed at the portions where the warps $T_{wr}$ cross the weft $T_{wf}$.

FIG. 7 shows an enlarged view of the cross section of the woven CF fabric. It exaggerates the CF yarns presenting the warps and weft to serve as a model.

Further, the following describes how a CF fabric is woven with warps and weft consisting of a plurality of layers of flat unit CF yarn.

Two or three bobbins 1 are prepared for the weft, the weft $T_{wf}$ paid out from each bobbin 1 being taken as the unit CF yarn. The two or three wefts $T_{wf}$ are guided to the draw-off roller 3 in a manner that they are piled on top of each other on the draw-off roller 3, then they go through the tension device 4 and the leaf spring tension device 8.

By inserting the laminated wefts $T_{wf}$ between the multiple warps $T_{wr}$ by the rapier 11, the laminated wefts $T_{wf}$ can be inserted between the multiple warps $T_{wr}$ without causing the flatness of the laminated weft $T_{wf}$ to be crushed.

For the warps, the warps $T_{wr}$ paid out from two or three bobbins 20*a* are piled on top of each other as the unit CF yarns. The laminated warps $T_{wr}$ are passed between the wires 21*b* and 21*b* of the comb 21, then guided to between the dents 24*b* and 24*b* of the reed 24 via the horizontal guide 22 and the healds 23.

Thus, in the weaving method and weaving apparatus for the CF yarn according to the present invention, a CF fabric woven with the wefts $T_{wf}$ and warps $T_{wr}$ consisting of laminated unit CF yarns will be obtained.

Figure 8:
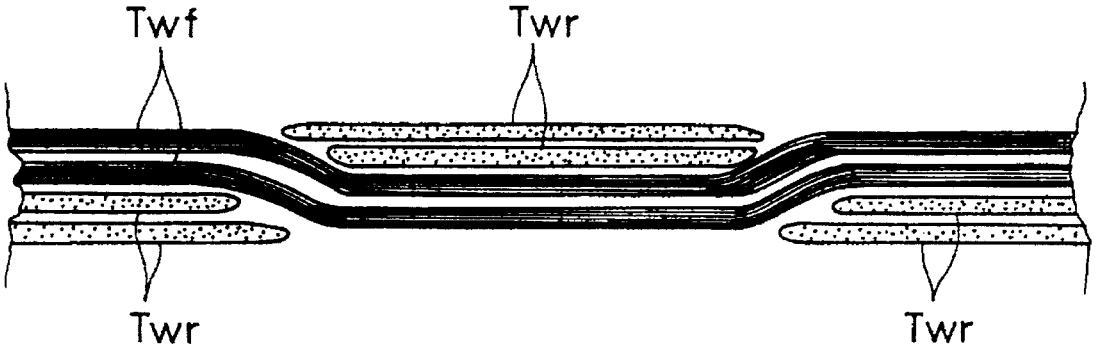
FIG. 8 is a cross-sectional view of the CF fabric according to the present invention which has been woven using warp and weft consisting of two flat unit CF yarns formed in layers.

The CF fabric thus woven with the wefts $T_{wf}$ and the warps $T_{wr}$ consisting of two layered unit CF yarns shows a uniform fiber density but hardly shows crimps at the portions where the warps $T_{wr}$ and the wefts $T_{wf}$ cross each other as shown in FIG. 8.

FIG. 8 shows an enlarged view of the cross section of the woven CF fabric and the CF yarns presenting the warps and weft are exaggerated as in FIG. 7.

Based on the weaving methods described above, the following explains about embodiments related to the CF fabric woven using the aforesaid weaving apparatus.

EXAMPLE 1

The CF fabric according to the present invention was woven by the weaving method and weaving apparatus according to the present invention with the main rotary shaft 26 running at a speed of 120 rpm, using a flat CF yarn, which is 6.5 mm in width and 0.12 mm in thickness and whose shape is maintained by applying 0.8% of a sizing agent, the flat CF yarn consisting of a twist-free CF yarn [TORAYCA T700SC-12K (the number of carbon fibers: 12,000; yarn size: 7,200 deniers)] made by Toray Industries, Inc. and having a tensile break strength of 500 kg.f/mm$^2$, a tensile modulus of 23,500 kg.f/mm$^2$, and a tensile break elongation of 2.1%.

The obtained CF fabric is a plain weave, the density of the warps and wefts being 1.25 ends/cm, the yarn width of the warp and weft being 7.6 mm, the yarn thickness being 0.11 mm, the ratio of the yarn width to the yarn thickness being 69.1, the ratio of the weaving yarn pitch between warps and wefts to the yarn width being 1.05, the fabric thickness being 0.22 mm, the weight of woven fabric being 200 g/m$^2$, and the fiber density being 0.91 g/cm$^3$.

The warps and wefts of the CF fabric are free of take-out twists and have a cover factor is 99.8%, meaning that there is almost no gaps. Thus, the CF fabric has a uniform fiber density and smooth surface.

Moreover, the weaving yarn density of the CF fabric is ¼ of that of the conventional CF fabric which is a plain weave made of a similar CF yarn [TORAYCA T300B-3K (the number of carbon fibers: 3,000; yarn size: 1,800 deniers)] made by Toray Industries, Inc. and which has a warp and weft density of 5.0 ends/cm, and a weight of woven fabric of 200 g/m$^2$. Therefore, the weaving speed for the CF fabric is four times as fast as that for the conventional fabric, resulting in significantly improved productivity.

Next, the obtained CF fabric was infiltrated with 36 percentage by weight of an epoxy resin having a tensile break elongation of 3.5% to produce a prepreg. The prepreg exhibited a smooth surface just like the CF fabric and uniformly distributed carbon fibers.

Then, the prepreg was laid up in four plies in the same orientation to make a CFRP by the autoclave molding method. The tensile break strength and the tensile modulus of the CFRP were measured in accordance with the CFRP tensile testing method of ASTM D3039.

The results are shown in Table 1 which also gives the volume content of the carbon fiber. During the measurement, the CFRP broke at 1.6% elongation of the CF yarn, however, it did not develop microcracks in the matrix resin in the transverse direction which crosses the tensile direction at right angle.

TABLE 1

| Description | Ex. 1 | Com. 1-1 | Com.1-2 |
|---|---|---|---|
| CF Volume Content (%) | 55 | *55 | 55 |
| Tensile B. Strength (kg · f/mm$^2$) | 107.2 | *82.6 | 91.5 |
| Tensile modulus (kg · f/mm$^2$) | 6800 | *6500 | 6800 |

Ex. : Example
Com.: Comparative Example
Tensile B. Strength: Tensile break strength

Comparative Example 1-1

For the purpose of comparison, the CF yarn of Example 1 was used to weave a plain-weave CF fabric at a warp and weft density of 1.25 ends/cm using a known single-sided rapier loom according to a conventional weaving method wherein the weft is taken out longitudinally and the multiple warps are taken out transversely, then the individual warps are guided in sequence to the round hole guide of the warp creel, the arranging guide, and the healds having mails which are long vertically.

The warps of the resulting fabric are woven squeezed with their flatness destroyed. The weft was squeezed with three to four take-out twists per meter, and the cover factor was 85.0% which means an extremely coarse texture, the fabric surface displaying irregularities. In the woven fabric, the yarn width of the warps and weft was 4.9 mm, the ratio of the yarn width to the yarn thickness 28.8, the ratio of the weaving pitch to yarn width 1.63, the fabric thickness 0.34 mm, the weight of woven fabric 200 g/m$^2$, and the fiber density of 0.59 g/cm$^3$.

The fabric was infiltrated with an epoxy resin having a tensile break elongation of 3.5% in the same manner as in Example 1 to make a prepreg. At this time, the resin in the gaps in the fabric was taken off and lost by a mold release film; therefore, resin had to be added to fill the lost portion.

The prepreg thus produced was laid up in four plies in the same orientation to make a CFRP by the autoclave molding method as in Example 1.

The obtained CFRP had an uneven surface with depressions at the gaps in the fabric and many voids were observed.

The tensile break strength and the tensile modulus of the CFRP were measured according to the testing method used for Example 1. The results are shown in Table 1 which also indicates the carbon fiber volume content.

The actual measurement of the carbon fiber volume content of the acquired CFRP was 44%; therefore, Table 1 shows the values obtained by converting the carbon fiber volume content to 55%.

As it is obvious from the results given in Table 1, the CFRP made of the CF fabric according to the present invention provides extremely high tensile break strength and also high tensile modulus which are unthinkable with conventional CF base fabric.

In contrast with the above-mentioned CFRP, the CFRP of Comparative Example 1-1 uses a reinforcing base fabric which has a low fiber density, 0.60 g/cm$^3$; therefore, the carbon fiber volume content is accordingly low and the matrix resin unevenly exists in the gaps in the fabric, causing cracks to occur. As it is obvious from the results of Comparative Example 1-1, this CFRP has a lower tensile break strength than that of the CFRP of Example 1.

Comparative Example 1-2

The CF fabric according to the present invention shown in Example 1 was woven, and the fabric was infiltrated with an epoxy resin with a 1.7% tensile break elongation to make prepregs, then a CFRP was made in the same manner as in Example 1.

The tensile break strength and the tensile modulus of the CFRP were measured according to the testing method used for Example 1. The results are shown in Table 1 which also indicates the carbon fiber volume content.

Since the CFRP has the low matrix tensile break elongation, 1.7%, microcracks took place early in the lateral direction which crosses with the pulling direction. As it is seen from Table 1, the tensile break strength of the CFRP is lower than that of Example 1.

EXAMPLE 2

Using the CF yarn shown in Example 1, the CF fabric according to the present invention was woven by the weaving method and weaving apparatus according to the present invention. The fabric was infiltrated with a vinyl ester resin (RIPOXY, R804 made by SHOWA HIGHPOLYMER CO., LTD.) by hand lay-up, and four plies of the fabric were layered and cured at room temperature (25° C.) to produce a CFRP.

Despite that the CFRP was produced by the hand lay-up molding, it exhibited a high carbon fiber volume content, 45%, and was infiltrated thoroughly with the resin and free of voids. This was made possible by the high fiber density, 0.91 g/cm$^3$ of the woven CF fabric.

The tensile break strength and the tensile modulus of the CFRP thus acquired were measured according to the testing method used for Example 1. As shown in Table 2, the strength of the CFRP proved to be as high as that of the CFRP which was obtained by the autoclave molding method in Example 1.

The retention of the tensile strength shown in Table 2 refers to a percentage of actual measurements to the theoretical strength values calculated from the strength of CF.

TABLE 2

| Description | Ex. 2 | Com. 2 |
|---|---|---|
| CF volume content (%) | 45.4 | 32.1 |
| Tensile B. strength (kg · f/mm$^2$) | 97.2 | 32.3 |
| Tensile modulus (kg · f/mm$^2$) | 5400 | 3700 |
| Retention of tensile strength (%) | 85.6 | 55.9 |

Ex.: Example
Com.: Comparative Example
Tensile B. strength: Tensile break strength

Comparative Example 2

A CF fabric was woven by the conventional weaving method shown in Comparative Example 1-1, using a flat CF yarn, which is 2 mm in width and 0.1 mm in thickness and whose shape is maintained by applying 1.0% of a sizing agent, the flat CF yarn consisting of a CF yarn [TORAYCA T300B-3K (the number of carbon fibers: 3,000; yarn size: 1,800 deniers)] made by Toray Industries, Inc. and having a tensile break strength of 360 kg.f/mm$^2$, a tensile modulus of 23,500 kg.f/mm$^2$, and a tensile break elongation of 1.5%.

The obtained CF fabric was a plain weave, the density of the warps and wefts being 5.0 ends/cm, the yarn width of the warp and weft being 1.6 mm, the yarn thickness being 0.13 mm, the ratio of the yarn width to the yarn thickness being 12.3, the ratio of the weaving yarn pitch to the yarn width being 1.25, the woven fabric thickness being 0.27 mm, the weight of woven fabric being 200 g/m$^2$, and the fiber density being 0.74 g/cm$^3$.

As in Example 2, the woven fabric was infiltrated with the aforesaid vinyl ester resin by hand lay-up, and the woven fabric was layered in four plies then cured at room temperature (25° C.) to produce a CFRP. The resulting CFRP exhibited a normal value of carbon fiber volume content, 32.1%, and good resin infiltration property.

The tensile break strength and the tensile modulus of the CFRP were measured according to the testing method in Example 1. The results are shown in Table 2 which also indicates the carbon fiber volume content and the retention of the tensile strength.

The CF fabric of Comparative Example 2 presents no problem with the resin infiltration property, and it was different from the CF fabric in Example 2 only in the CF yarn used. As shown in Table 2, however, the tensile break strength of the CFRP in Comparative Example 2 was extremely low compared with the CFRP of Example 2. This result can be understood from the retention of the tensile strength which crimps of weaving CF yarns contribute to the strength of the CFRP.

While the fiber density of the CF fabric of the CFRP in Comparative Example 2 was 0.74 g/cm$^3$, the CF fabric used for the CFRP in Example 2 had a high fiber density, 0.91 g/cm$^3$ and therefore the carbon fiber volume content in the CFRP was accordingly higher, and also the CF fabric in Example 2 had smaller crimps of weaving yarn, resulting in high strength.

Figure 9:
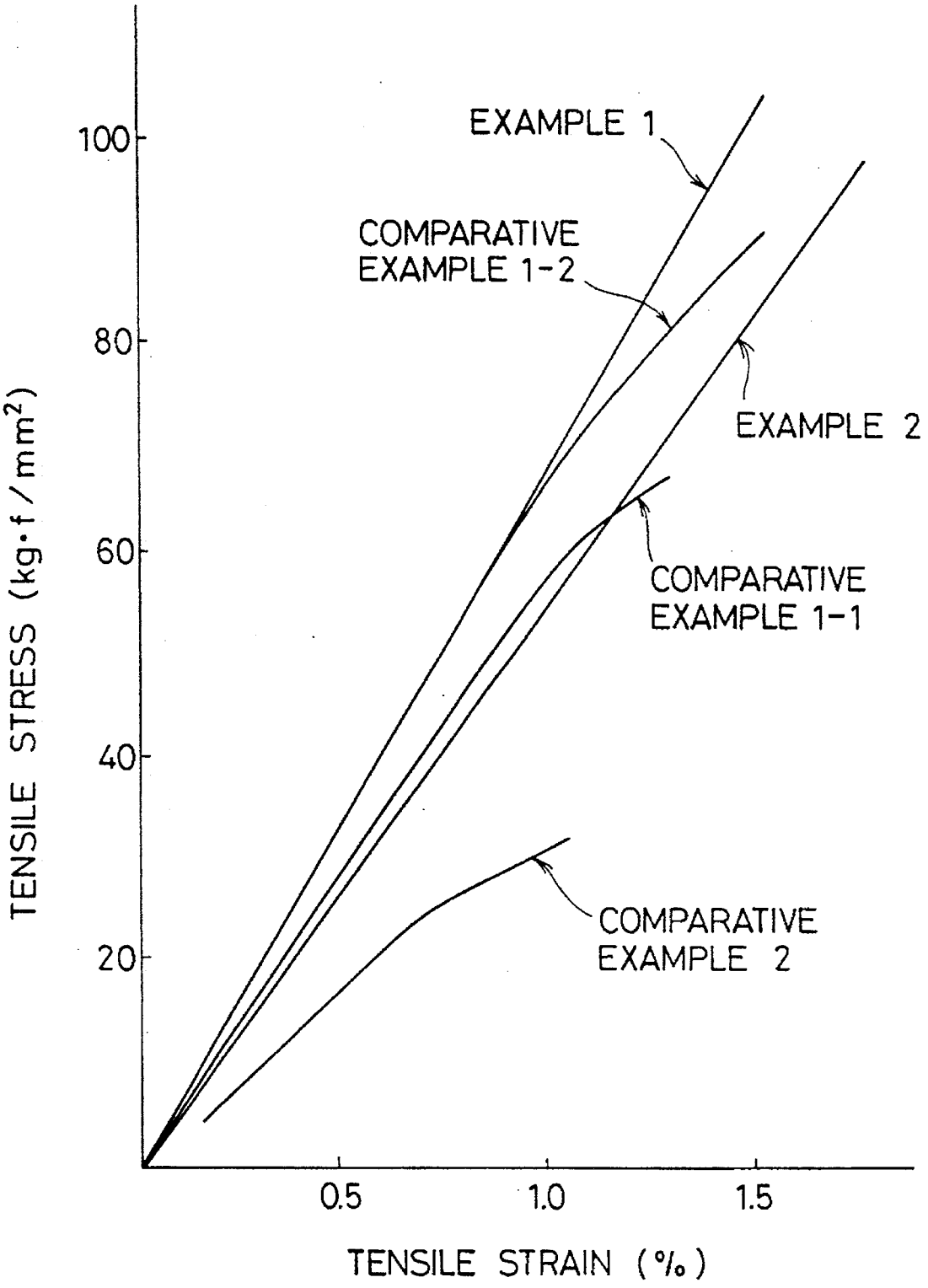
FIG. 9 is a tensile strength characteristic diagram related to the stress-strain curve of a CFRP which is made of the CF fabric according to the present invention.

Based on the tensile test in Examples 1 and 2, Comparative Examples 1-1, 1-2, and Comparative Example 2, the strength characteristic diagram shown in FIG. 9 was drawn, taking the tensile strain (%) on the X-axis and the tensile stress (kg.f/mm$^2$) on the Y-axis.

As it is obvious from FIG. 9, define is observed in the tensile modulus preceding the break strain which is considered due to the occurrence of cracks that started with a gap having much matrix resin in the CFRP of Comparative Example 1-1 or due to the occurrence of microcracks in the lateral direction which crosses with the pulling direction at right angle in the CFRP of Comparative Example 1-2.

Also in the CFRP of Comparative Example 2, the changing rate of the tensile modulus started to drop around a tensile strain of 0.6%. This is presumed attributable to the crimps of the CF yarn used being stretched and the infiltrated resin could no longer support the CF yarn. This presumption is based on the cracks which were observed in the resin of the CFRP of Comparative Example 2.

Hence, when using this CFRP as a structural material, it is dangerous to attempt to depend on the tensile break strength. It is necessary to take a lower tensile break strength as a basis.

EXAMPLE 3

The CF fabric according to the present invention was woven by the weaving method and weaving apparatus according to the present invention, using a flat CF yarn, which is 6.5 mm in width and 0.12 mm in thickness and whose shape is maintained by applying 0.8% of a sizing agent, the flat CF yarn consisting of a twist-free CF yarn [TORAYCA T700SC-12K (the number of carbon fibers: 12,000; yarn size: 7,200 deniers)] made by Toray Industries, Inc. and having a tensile break strength of 500 kg.f/mm$^2$, a tensile modulus of 23,500 kg.f/mm$^2$, and a tensile break elongation of 2.1% as the warp, and a glass fiber yarn [ECE225-1/2 (the number of fibers: 460; yarn size: 405 deniers) made by Nitto Boseki Co., Ltd.] as the auxiliary yarn for the weft.

The obtained CF fabric is a unidirectional plain weave, the density of the warp being 1.25 ends/cm, the density of the weft being 2.5 ends/cm, the yarn width of the warp being 7.8 mm, the warp thickness being 0.1 mm, the ratio of the yarn width to the yarn thickness of the warp being 78, the ratio of the weaving yarn pitch to the yarn width of the warp being 1.03, the fabric thickness being 0.11 mm, the weight of woven fabric being 111 g/m$^2$, and the fiber density being 1.01 g/cm$^3$.

The CF fabric was a thin fabric which had a uniform fiber density and had no gaps between adjacent warps.

The fabric was infiltrated with the vinyl ester resin in Example 2 by hand lay-up, and four plies of the resulting fabric were layered in the same orientation, then cured at room temperature (25° C.) to produce a CFRP.

The tensile break strength of the CFRP in the direction of the CF fiber orientation was evaluated according to the test method used in Example 1. The results are shown in Table 3 which also gives the carbon fiber volume content and the tensile modulus.

The obtained CFRP exhibited high carbon fiber content and high tensile break strength despite that it was produced by the hand lay-up molding.

Comparative Example 3

A plain weave unidirectional CF fabric was woven according to the conventional weaving method described in Comparative Example 1-1, using a CF yarn for the warp (warp yarn density: 1.25 ends/cm) and a glass fiber yarn (auxiliary yarn) for the weft (weft yarn density: 2.5 ends/cm) respectively in Example 3.

The obtained CF fabric had an extremely coarse texture with gaps between warps, the warp width being 5.0 mm, the warp thickness being 0.15 mm, the ratio of the yarn width to the yarn thickness of the warp being 33, the ratio of the weaving pitch to the yarn width of the warp being 1.60, the fabric thickness being 0.16 mm, the weight of woven fabric being 111 g/m$^2$, and the fiber density being 0.69 g/cm$^3$.

This fabric was used to make a CFRP by the hand lay-up molding described in Example 3, and the tensile break strength was evaluated according to the test method in Example 1. The results are shown in Table 3.

TABLE 3

| Description | Ex. 3 | Com. 3 |
|---|---|---|
| CF volume content (%) | 56.0 | 33.5 |
| Tensile B. strength (kg · f/mm$^2$) | 245.4 | 104.9 |
| Tensile modulus (kg · f/mm$^2$) | 12600 | 7600 |

Ex.: Example
Com.: Comparative Example
Tensile B. strength: Tensile break strength As it is obvious from Table 3, the carbon fiber volume content and the tensile break strength of the CFRP of Comparative Example 3 were about 34% and about 105 kg.f/mm$^2$, respectively, which were both lower than those of the CFRP of Example 3.

Observation of the CFRP of Example 3 revealed that its resin had been uniformly infiltrated in the CF fabric with almost no voids in contrast to the CFRP of Comparative Example 3.

EXAMPLES 4–8

CF fabrics were woven by the weaving method and weaving apparatus according to the present invention, using the twist-free CF yarn (TORAYCA T700SC made by Toray Industries, Inc.) used in Example 1 but using different numbers of fibers, different yarn widths and different sizes of yarn. Table 4 shows the CF yarns used, the specifications of the woven fabrics, and the woven fabric characteristics of the obtained CF fabrics.

Then, each of the CF fabrics was infiltrated with 36 percentage by weight of an epoxy resin having a tensile break elongation of 3.5% to produce prepregs. Four plies of each prepreg were layered in the same orientation and CFRPs were produced by the autoclave molding method. The tensile break strength and the tensile modulus of all the CFRPs were measured in accordance with the CFRP tensile

TABLE 4

| Description | Ex. 4 | EX. 5 | Ex. 6 | Ex. 7 | Ex. 8 | Com. 4 | Com. 5 | Com. 6 | Com. 7 | Com. 8 |
|---|---|---|---|---|---|---|---|---|---|---|
| CF Yarn | | | | | | | | | | |
| No. of fibers | 6,000 | 6,000 | 12,000 | 12,000 | 24,000 | 6,000 | 6,000 | 12,000 | 12,000 | 24,000 |
| Yarn width (mm) | 6.5 | 6.5 | 12 | 6.5 | 16 | 6.5 | 6.5 | 12 | 6.5 | 16 |
| Twist | None | None | None | None | None | None | None | None | None | None |
| Size | 3,600 | 3,600 | 7,200 | 7,200 | 14,400 | 3,600 | 3,600 | 7,200 | 7,200 | 14,400 |
| Fabric Spec. | | | | | | | | | | |
| Take-out twist | None | None | None | None | None | None | None | None | None | None |
| Yarn width (mm) | | | | | | | | | | |
| Warp | 7.8 | 4.8 | 10.9 | 5.1 | 14.5 | 7.9 | 2.5 | 11.0 | 3.8 | 7.6 |
| Weft | 6.7 | 4.8 | 10.1 | 5.1 | 13.8 | 6.7 | 2.4 | 10.2 | 3.8 | 7.6 |
| Yarn W/T ratio | | | | | | | | | | |
| Warp | 122 | 51 | 145 | 32 | 145 | 132 | 16 | 73 | 21 | 37 |
| Weft | 120 | 51 | 135 | 32 | 125 | 113 | 15 | 73 | 21 | 37 |
| WY Pitch/YW ratio | | | | | | | | | | |
| Warp | 1.03 | 1.04 | 1.05 | 1.04 | 1.10 | 1.26 | 1.11 | 1.45 | 1.05 | 1.05 |
| Weft | 1.19 | 1.04 | 1.13 | 1.04 | 1.16 | 1.49 | 1.16 | 1.57 | 1.05 | 1.05 |
| Weight (g/m$^2$) | 100 | 160 | 140 | 300 | 200 | 80 | 300 | 100 | 400 | 400 |
| Fabric T. (mm) | 0.12 | 0.19 | 0.15 | 0.32 | 0.21 | 0.13 | 0.31 | 0.14 | 0.36 | 0.41 |
| Fiber D. (g/cm$^3$) | 0.83 | 0.84 | 0.93 | 0.94 | 0.95 | 0.62 | 0.97 | 0.71 | 1.11 | 0.98 |
| Characteristics | | | | | | | | | | |
| Cover factor (%) | 99.6 | 99.8 | 99.5 | 99.9 | 99.8 | 93.1 | 99.3 | 88.7 | 9.8 | 99.8 |
| Surface smoothness | Good | Good | Good | Good | Good | Bad | Slightly bad | Bad | Slightly bad | Slightly bad |

Yarn W/T ratio: Yarn width/thickness ratio
WY pitch/YW ratio: Ratio of weaving yarn pitch to yarn width
Fabric T.: Fabric thickness
Fiber D.: Fiber density

TABLE 5

| | Ex. 4 | EX. 5 | Ex. 6 | Ex. 7 | Ex. 8 | Com. 4 | Com. 5 | Com. 6 | Com. 7 | Com. 8 |
|---|---|---|---|---|---|---|---|---|---|---|
| CF volume content (%) | 55.0 | 54.2 | 55.8 | 54.0 | 54.1 | 42.0 | 54.0 | 45.0 | 55.0 | 53.0 |
| Tensile B. strength (kg · f/mm$^2$) | 103.1 | 97.6 | 110.2 | 105.1 | 101.5 | 73.5 | 79.8 | 74.8 | 75.5 | 80.1 |
| Tensile modulus (kg · f/mm$^2$) | 6,800 | 6,750 | 6,850 | 6,800 | 6,750 | 5,300 | 6,600 | 5,500 | 6,650 | 6,550 |
| Surface smoothness | Good | Good | Good | Good | Good | Bad | Slightly bad | Bad | Bad | Bad |
| Void rate (%) | 0.9 | 1.0 | 0.5 | 0.6 | 0.5 | 2.8 | 4.0 | 2.9 | 5.1 | 4.5 |

test method of ASTM D3039.

The results are shown in Table 5 which also gives the carbon fiber volume content, surface smoothness, and void rate.

Comparative Examples 4–8

For the purpose of comparison, using the same CF yarn used for Examples 4 through 8, five types of CF fabrics which differ in yarn width, ratio of yarn width to yarn thickness, ratio of weaving pitch to yarn width, weight of woven fabric, fabric thickness, and fiber density. Table 4 shows the specifications and characteristics of these CF fabrics.

Then, each of the CF fabrics was infiltrated with 36 percentage by weight of an epoxy resin having a tensile break elongation of 3.5% to produce prepregs. Four plies of each prepreg were layered in the same orientation and CFRPs were produced by the autoclave molding method. The tensile break strength and the tensile modulus of all the CFRPs were measured in accordance with the CFRP tensile test method of ASTM D 3039. The results are shown in Table 5 which also gives the carbon fiber volume content, surface smoothness, and void rate.

As it is obvious from Table 4, the CF fabrics of Examples 4 through 8 have higher cover factors and smoother fabric surfaces on the average than the CF fabrics of Comparative Examples 4 through 8.

The CF fabrics of Comparative Examples 4 and 6 were woven by the weaving method and weaving apparatus according to the present invention in a manner that the flatness of the CF yarn would not be crushed. However, the weight of woven fabric and fabric thickness were extremely small for the yarn size of the CF yarn used, and therefore, the gaps between the warp and weft were large with a resultant small cover factor.

In addition, the CFRPs using the CF fabrics in Comparative Examples 4 and 6 have larger gaps between warp and weft than those in the CFRPs using the CF fabrics in Examples 4 through 8; therefore, they exhibited lower tensile break strength and tensile modulus as shown in Table 5.

The weight of woven fabric and fabric thickness of the CF fabrics of Comparative Examples 5, 7, and 8 were extremely large for the yarn size of the CF yarn used, and therefore, the CF fabrics had a high cover factor and fiber density but exhibited poor smoothness and they were too thick as it is obvious from Table 4.

Hence, as it is obvious from Table 5, the CFRPs using the CF fabrics in Comparative Examples 5, 7, and 8 exhibited poor surface smoothness and a high void rate; therefore, their tensile break strength and tensile modulus were lower than those of the CFRPs which used the CF fabrics in Examples 4 through 8.

EXAMPLE 9

A CF fabric was woven by the weaving method according to the present invention, using the flat, twist-free CF yarn (the number of carbon fibers: 12,000; yarn size: 7,200 deniers; yarn width: 6.5 mm; yarn thickness: 0.12 mm), which was used in Example 1, as the unit CF yarn, the unit CF yarns being taken out by the draw-off roller 3 of the weft supply unit from two bobbins 1, which are installed beforehand, and the two yarns being layered to provide the weft, and the unit CF yarns being taken out from two bobbins 20*a* of the warp supply unit and the two yarns being layered to provide the warp in the weaving apparatus, and the density of the warp and weft being 1.56 ends/cm.

The CF yarn used, fabric specifications and fabric characteristics of the obtained CF fabric are shown in Table 6 below.

Then, each of the CF fabric thus produced was infiltrated with 36 percentage by weight of an epoxy resin having a tensile break elongation of 3.5% to produce prepregs as in Examples 4 through 8. Four plies of each prepreg were layered in the same orientation and CFRPs were produced by the autoclave molding method. The tensile break strength and the tensile modulus of all the CFRPs were measured in accordance with the CFRP tensile test

TABLE 6

| Description | Example 9 | Comparative Example 9 |
|---|---|---|
| CF Yarn | | |
| No. of fibers | 12,000 | 12,000 |
| Yarn width (mm) | 6.5 | 6.5 |
| Twist | None | None |
| Size of yarn | 7,200 | 7,200 |
| Specification of Woven Fabric | | |
| Take-out twist | None | None |
| No. of yarn layers | 2 | 1 |
| Yarn width (mm) | | |
| Warp | 6.1 | 3 |
| Weft | 6.0 | 3 |
| Yarn W/T ratio | | |
| Warp | 51 | 12 |
| Weft | 50 | 12 |
| WY pitch/YW ratio | | |
| Warp | 1.02 | 1.07 |
| Weft | 1.04 | 1.07 |
| Weight (g/m$^2$) | 500 | 500 |
| Fabric Thickness (mm) | 0.50 | 0.52 |
| Fiber D. (g/cm$^3$) | 1.00 | 0.97 |

TABLE 6-continued

| Description | Example 9 | Comparative Example 9 |
|---|---|---|
| Characteristics | | |
| Cover factor (%) | 99.9 | 99.8 |
| Surface smoothness | Good | Slightly bad |

Yarn W/T ratio: Yarn width/thickness ratio
WY pitch/YW ratio: Ratio of weaving yarn pitch to yarn width
Fiber D.: Fiber density method of ASTM D3039.

The results are shown in Table 7 which also gives the carbon fiber volume content, surface smoothness, and void rate.

As it is obvious from Table 6, the CF fabric according to this example had a large weight of woven fabric and possible poor resin infiltration was concerned.

However, the CF yarns of the CF fabric of this

TABLE 7

| Description | Example 9 | Comparative Example 9 |
|---|---|---|
| CF volume content (%) | 54.2 | 54.8 |
| Tensile B. strength (kg · f/mm$^2$) | 97.1 | 72.5 |
| Tensile modulus (kg · f/mm$^2$) | 6,700 | 6,400 |
| Surface smoothness | Good | Bad |
| Void rate (%) | 0.9 | 3.6 |

example lie on top of one another flatly, and therefore, resin was fully infiltrated through the gaps between the flat CF yarns at the time of molding the prepreg, preventing large voids from occurring. The produced CFRP exhibited high tensile break strength as shown in Table 7.

Comparative Example 9

For the purpose of comparison, a CF fabric was woven by the weaving apparatus and method according to the present invention, to obtain Comparative Example 9. In Comparative Example 9, the twist-free, flat unit CF yarn, which was used in Example 9, was not arranged in layers, and was woven in such a manner that the fabric was a plain weave with a warp and weft density of 3.13 ends/cm, the weight of woven fabric being the same 500 g/m$^3$ as that of the CF fabric obtained in Example 9, and the warp and weft being not twisted. The CF yarn used, fabric specifications, and fabric characteristics of the obtained CF fabric are shown in Table 6.

As shown in Table 6, the obtained fabric exhibited the same high cover factor as in Example 9, however, its weaving yarn pitch of the warp and weft was 3.2 mm (=3×1.07) which is smaller than the weaving pitch of Example 9 (Warp: 6.2 mm=6.1×1.02; Weft: 6.2 mm=6.0×1.04) and therefore, the flat CF yarn was crushed widthwise, causing an uneven surface.

Using the CF fabric thus produced, a prepreg was made in the same manner as in Example 9 to produce a CFRP. The tensile break strength and the tensile modulus of the obtained CFRP were measured as in Example 9. The results are shown in Table 7 which also gives the carbon fiber volume content, surface smoothness, and void rate.

The CF fabric of this comparative example had a larger weight of woven fabric and it also had some portions where the gaps through which the matrix resin permeates were completely stopped. This led to poor resin infiltration in the manufacturing process of the prepreg.

For this reason, as shown in Table 7, the produced CFRP exhibited poor surface smoothness and a high void rate. Also, the tensile break strength and tensile modulus of the CFRP were lower than those of the CFRP which used the CF fabric of Example 9.

Accordingly, as it is obvious from the results of Example 9 and Comparative Example 9, the resin infiltration property does not deteriorate in the CF fabric woven with warp and weft made of layers of flat, twist-free unit CF yarn even if the weight of woven fabric is large.

What is claimed is:

1. A weaving method including a warp supply process for supplying twist-free flat warp having opposed flat surfaces and containing carbon fiber to a weaving loom, said warp supply process including the steps of:

transversely removing a plurality of said flat warps from a plurality of bobbins;

twisting the plurality of flat warps along a longitudinal travelling direction of said flat warps so that the flat surfaces of individual flat warps are oriented at a right angle to an arranged direction;

reeding the plurality of flat warps to a desired density in relation to the arranged direction;

again twisting the plurality of flat warps along said longitudinal travelling direction after reeding the plurality of flat warps so that the flat surfaces of the individual flat warps are oriented to said arranged direction; and supplying the plurality of flat warps to said weaving loom.

2. The weaving method as set forth in claim 1, and further including a weft supply process including the steps of:

transversely removing weft from a bobbin at a substantially constant speed;

intermittently supplying said weft to a rapier of said weaving loom;

accumulating a length of weft required for each insertion of weft for said warps, at a location between a point where said weft is removed from said bobbin and a point where said weft is supplied to said rapier; and applying an elastic force to said length of weft so as to take up any slack in said weft and thereby prevent twisting of said weft.

3. A weaving apparatus including a plurality of healds and a warp supply means for supplying a twist-free flat warp containing carbon fibers to a weaving loom, said warp supply means including:

a reed having a plurality of wires for reeding the individual warps taken out from a plurality of warp bobbins wound with flat warps and arranging the flat warps to a desired density while maintaining the flatness of the warps;

a guide which changes the orientation of said plurality of warps received from the reed into a direction that crosses with the plurality of wires of said reed at a right angle; and said plurality of healds which to form a shuttle path open and close said plurality of warps received form the guide while maintaining their new orientation.

4. The weaving apparatus as set forth in claim 3, and further including a weft supply means including:

a draw-off roller for taking out transversely at a constant speed weft from a thread bobbin wound with twist-free flat weft containing carbon fibers, said draw-off roller including means for rotating and interlocking with a rotary main shaft of said weaving loom;

at least two guide rollers which horizontally place said taken out weft in a weft supply position;

a weft elastic accumulation mechanism which elastically accumulates the weft of a length required for each insertion of weft into said warps at a location between said draw-off roller and said guide rollers, said weft elastic accumulation mechanism supplying the weft to said at least two guide rollers; and a tension applying mechanism which keeps under tension the weft received from said guide rollers.

5. A weaving method including a warp supply process for supplying twist-free flat warp having opposed flat surfaces and containing carbon fiber to a weaving loom, said warp supply process including the steps of:

transversely removing a plurality of said flat warps from a plurality of bobbins;

holding the plurality of flat warps so that their flat surfaces are in a direction crossing at a right angle to an arranged direction and reeding the plurality of flat warps to a desired density in relation to the arranged direction;

changing the direction of the flat surfaces of the individual warps to said arranged direction after reeding the plurality of flat warps; and supplying the plurality of flat warps to said weaving loom;

and further including a weft supply process including the steps of:

transversely removing weft from a bobbin at a substantially constant speed;

intermittently supplying said weft to a rapier of said weaving loom;

accumulating a length of weft required for each insertion of weft for said warps, at a location between a point where said weft is removed from said bobbin and a point where said weft is supplied to said rapier; and applying an elastic force to said length of weft so as to take up any slack in said weft and thereby prevent twisting of said weft.

* * * * *